United States Patent [19]

Jaffrennou et al.

[11] 4,398,844

[45] Aug. 16, 1983

[54] FLOATING BOOM STRUCTURE

[75] Inventors: Bernard Jaffrennou, Echirolles; Maurice Cessou, Communay, both of France

[73] Assignees: Institut Francais du Petrole, Rueil-Malmaison; Societe Rolba, Fontaine, both of France

[21] Appl. No.: 235,474

[22] Filed: Feb. 18, 1981

[30] Foreign Application Priority Data

Feb. 14, 1980 [FR] France ..... 80 03245

[51] Int. Cl.[3] ..... E02B 15/04

[52] U.S. Cl. ..... 405/72; 405/71; 114/270

[58] Field of Search ..... 114/270; 405/63, 65, 405/66, 67, 68, 69, 70, 71, 72; 210/DIG. 25

[56] References Cited

U.S. PATENT DOCUMENTS

| | | | |
|---|---|---|---|
| 3,786,637 | 1/1974 | Muramatsu et al. | 405/72 |
| 3,859,797 | 1/1975 | Ayers | 405/72 |
| 4,248,547 | 2/1981 | Brown | 405/72 |

*Primary Examiner*—Sherman D. Basinger
*Assistant Examiner*—Jesus D. Sotelo
*Attorney, Agent, or Firm*—Millen & White

[57] ABSTRACT

This floating boom comprises a flexible structure forming a barrier equipped with transverse stiffeners to which are secured floats adapted to support the flexible structure in a substantially vertical position in water. Each stiffener forms a buoyant unit with the floats secured thereto. The successive buoyant units are interconnected by an assembly of articulated linking rods longitudinally extending along the upper part of the boom. These longitudinal rods support the flexible structure which forms a barrier.

9 Claims, 6 Drawing Figures

1
2
3
4
5
6
7
8
9
10
11
12
13
14
15
19
20
21
22
23

FLOATING BOOM STRUCTURE

BACKGROUND OF THE INVENTION

The present invention relates to a new floating boom structure.

This boom structure is in particular suitable for defining shipping zones or water areas which may be used for aquatic activities, for example, as swimming areas or for "aquaculture".

A very important application of the invention is for fighting against water pollution caused by floating solid wastes or by chemical products, more particularly hydrocarbon spills.

The boom according to the invention may be used as a stationary boom stretched between two mooring points or as a net or trawl secured at its ends to one or more tug boats, in order to clean a polluted water area.

One presently used prior art boom type comprises those having a cylindrical buoyant member to which a skirt weighted at its lower part is secured, such as the booms described in French Patent No. 2,241,203 and in the publication Offshore, vol. 32, No. 6, June 5, 1972, pages 69–70, Tulsa, U.S.A. A second type of boom, described in French Patent No. 1 305 469, comprises a series of hingedly interconnected floating plates. A third boom type, described in the first addition No. 77 350 to French Patent No. 1 249 315 and in U.S. Pat. No. 4,016,726 comprises a flexible structure forming a barrier provided with transverse stiffeners to which are secured floats adapted to support the structure in a substantially upright position in water, so as to form a screen thereon.

This latter boom type offers, with respect to the former type, the advantage of having a substantially constant height above the water level, which facilitates containment of the polluting agents.

However, the stability of such booms with respect to winds, waves and water currents cannot be sufficiently ensured by the mere weighting of the flexible structure.

This stability can be improved, as described in French Patent No. 2 161 242, by locating the floats on one side or on both sides of the barrier at a distance therefrom as illustrated in French Patent No. 987 479, so-obtained stability being greater as the distance is increased.

A problem arising in a boom of this type is that the float groups distributed along the flexible structure forming the barrier must be maintained at a distance from each other by connecting means of sufficient flexibility to accomodate the swell movements, so that the boom can be deformed with the rolling, pitching, and yawing movements while keeping a substantially constant height above the water level as the boom is being hauled in a line and when it is in its working position, streched between two mooring points or tugged by one or several ships.

SUMMARY OF THE INVENTION

In accordance with the invention, this problem is solved by using a floating boom comprising a flexible structure forming a barrier provided with transverse stiffening members or stiffeners to which are secured floats adapted to support this flexible structure in the water in a substantially upright position, with each stiffener constituting a buoyant unit with the floats secured thereto, and the sucessive floating units being interconnected by an assembly of articulated linking rods longitudinally extending along the upper part of the boom these longitudinal rods supporting said flexible structure which forms a barrier.

Another problem encountered in a boom of the above-indicated type, and solved by the invention, is that of the connection between the transverse stiffeners and the floats.

Since the latter must be positioned at some distance from the barrier so as to ensure the stability of the boom, the connection between the stiffening members and the floats is subjected to high forces developed by waves, winds, and water currents, these forces being likely to cause breaking of the connection.

Morever, it is necessary that polluting agents, more particularly liquids, can flow freely along the boom towards a gathering point, so as to prevent accumulation which can cause leakage as a result of a driving or vortex effect caused by an increase in the thickness of the polluting layer.

It is possible to reduce embedding stresses applied to the arms interconnecting the floats and the stiffening members, while permitting the polluting agents to flow freely along the barrier by building a boom of the above-indicated type, wherein each stiffening member is connected to two floats located on both sides of the stiffening member and secured thereto by two connecting arms fixed at a distance from the upper edge of the stiffening member which does not exceed one fourth of the barrier height, these arms forming in operation an angle smaller than 90° with respect to a vertical line.

BRIEF DESCRIPTION OF THE DRAWINGS

Embodiments of the invention are illustrated by the accompanying drawings wherein.

DETAILED DISCUSSION OF THE INVENTION

Figures 1, 2, 3:
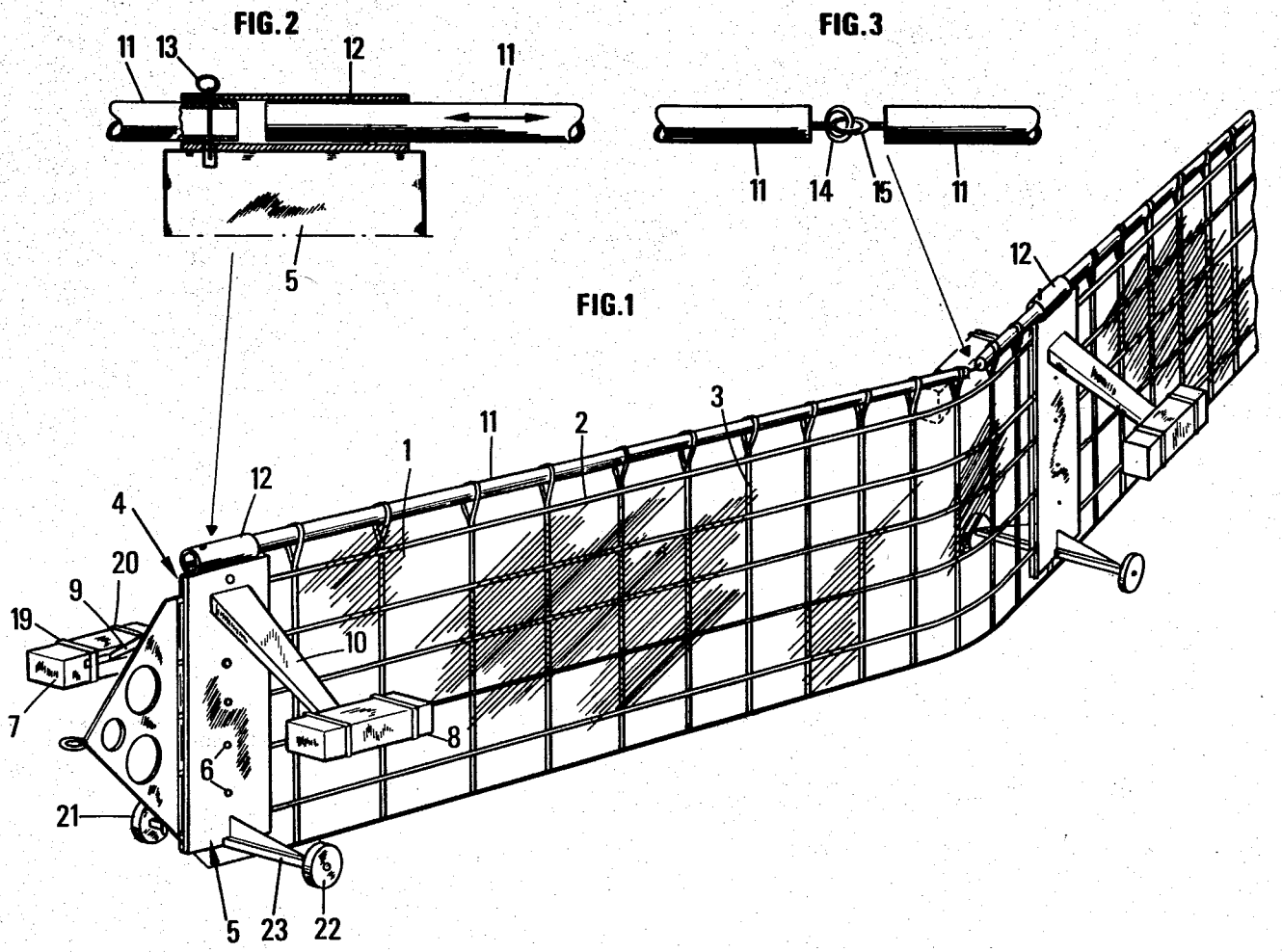
FIG. 1 is a perspective view of a boom according to the invention.
FIG. 2 is a longitudinal cross-sectional view of the sliding assembly of the connecting rods at the top of the stiffening members.
FIG. 3 shows one embodiment of the articulation of these rods.

FIG. 1 shows in part a boom according to the invention comprising a flexible structure forming a barrier constituted by a flexible skirt 1 and by an armouring comprising longitudinal elements of a high tensile strength which may advantageously be formed by strips of reinforced material and transverse resistant elements which maintain a predetermined spacing between the longitudinal elements. These transverse elements may consist of strips 3 of the same nature as the longitudinal strips 2.

The armouring may be formed by welding or by weaving of the elements 2 and 3.

Strips 2 and 3 may be, for example, made of a core of plastic material reinforced with highly resistant filaments, such as metal wires, glass fibers, carbon fibers, or fibers of plastic materials commonly used in the textile industry (polyamide, polyester, etc.).

The boom also comprises transverse stiffeners each of which is formed of two profiled elements 4 and 5 placed on both sides of the boom armouring which is pressed therebetween, optionally together with the skirt 1, these elements being interconnected by bolts or rivets 6, or by any other tightening means.

Thus, continuity of the traction resistant armouring is not interrupted at the location of the stiffeners which are not subjected to the traction loads applied to the boom, these loads being entirely supported by the armouring.

Floats 7 and 8 positioned at a distance from the flexible barrier are connected to the profiled elements 4 and 5 by the arms 9 and 10.

The stiffeners 4 and 5 and the floats 7 and 8 connected to these stiffeners by the arms 9 and 10 form a buoyant unit.

The boom comprises a plurality of such floating units interconnected at their upper part by an assembly of articulated longitudinal linking rods 11 to which is secured the flexible structure which forms a barrier.

For this purpose, each stiffener comprises at its upper end a sleeve 12 (which may, for example, be welded to one of the two members forming this stiffener) in which are inserted two rods 11 connecting the considered buoyant unit to the two adjacent buoyant units. The end of at least one of these connecting rods is adapted to slide in a sleeve 12. In the embodiment illustrated in FIG. 2 the end of one of the linking rods 11 is made integral with the sleeve 12 by a pin 13, while the end of the other rod 11 has limited sliding movement in the sleeve.

The rods are articulated preferably close to at least one of the interconnected stiffeners. This articulation is of a type enabling the deformation of the boom under rolling, pitching and yawing movements caused by the swell.

In the illustrated non-limitative embodiment, the articulation is formed by connecting two rings 14 and 15 of which at least one is rotatable about the longitudinal axis of the rod 11 to which this ring is secured.

Obviously other types of multidirectional connections may be used, for example of the ball-and-socket type.

The rods 11 having some stiffness may consist of metal tubes or rods of fiber glass, or of any other suitable material.

This arrangement makes it possible to maintain at a substantially constant distance from each other the successive buoyant units of the boom by a connection of sufficient flexibility to accomodate the movements of swell, so as to maintain substantially constant the boom height above the water level and the boom draught.

Thus, the boom may have in operation the configuration shown in broken line in FIG. 1.

The transverse strips 3 of the armouring will advantageously be folded about the connecting rods 11 at their upper part and be welded to themselves.

Figure 4:
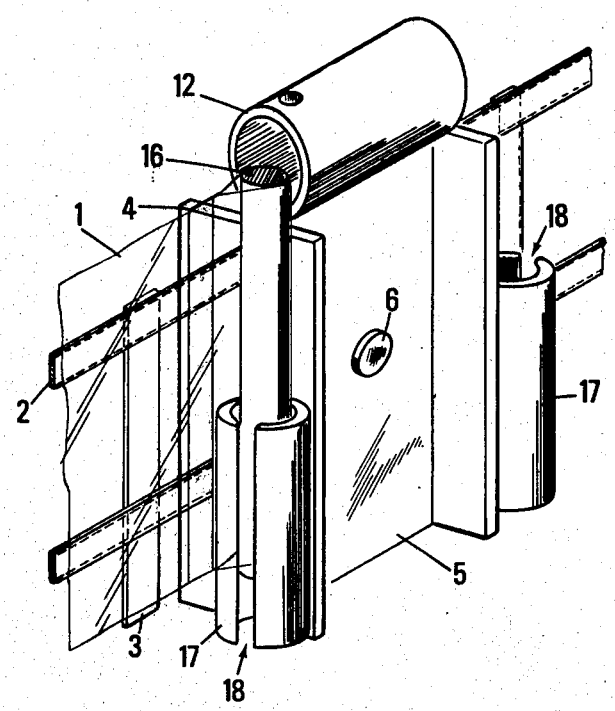
FIG. 4 shows an embodiment of the connecting means between the skirt and the stiffening members.

In order to facilitate repairing of the skirt 1, it may be advantageous to form it of successive elements each of which comprises at its ends a rod 16 (FIG. 4) on which the skirt is folded so as to be welded to itself. This rod is inserted in support members secured to the stiffeners, such as for example the tube 17 welded to one of the elements 4 or 5 of the stiffener and comprising the longitudinal slot 18 for insertion of the skirt.

In order to decrease the embedding stresses in the arms 9 and 10 connected with the stiffening elements 4 and 5, while providing along the barrier a zone free of any hindrance enabling the polluting fluids to freely flow along this barrier, the connecting arms 9 and 10 of the floats 7 and 8 are preferably secured to the stiffening elements 4 and 5 at a distance from the upper edge thereof which is at most equal to one fourth of the barrier height, these resistant arms 9 and 10 forming angles smaller than 90° with the stiffening elements 4 and 5.

The embedding stresses in the connecting arms 9 and 10 are thus reduced because a fraction of the vertical bearing reactions of the float on water is transformed into an axial thrust on the connecting arms.

The floats 7 and 8 may be formed by a rigid housing of metal or plastic material filled with a plastic foam having closed pores (for example, polyurethane).

As illustrated in FIG. 1, the floats may be rectangular or cylindrical and secured to the connecting arms 9 and 10 by means of collars or clamps 19 and 20.

Figure 5:
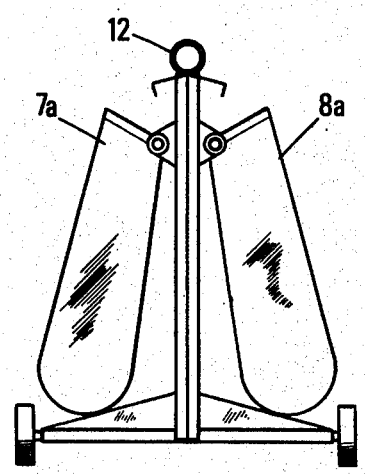
FIGS. 5 and 6 illustrate particular embodiments wherein the floats form a single-piece assembly with the arms connecting them to the stiffening members, and hingedly connected to the latter.
Figure 6:
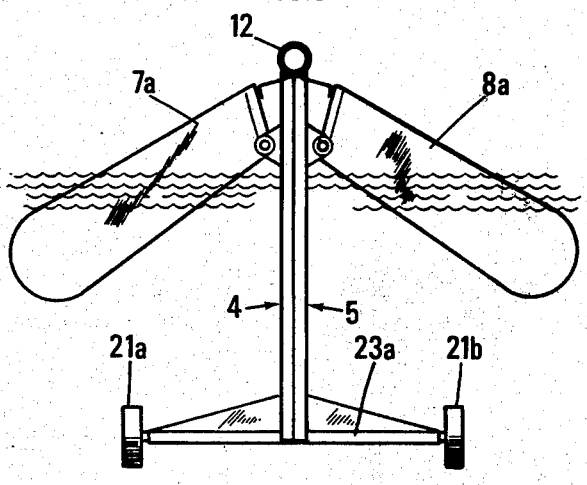

FIGS. 5 and 6 illustrate a particularly interesting embodiment in which each float forms with the arm connecting this float to the stiffener an integral or single-piece profiled assembly whose cross-section progressively decreases from the end of the float to its fastening point on the stiffening element 4 or 5.

This type of float has the advantage of being more easily manufactured.

Moreover with this type of float, any inclination of the boom results in a substantial increase of the submerged volume of the floats and consequently in an increase of the upward buoyancy thrust and thus of the uprighting torque.

It may be advantageous, as well in the embodiment illustrated in FIG. 1 as in the above-mentioned embodiment, to have the float-connecting arm assembly pivotally connected about a horizontal shaft integral with the stiffening element.

In this manner the floats 7*a*, and 8*a*, come into abutment against the stiffeners under the action of their own weight when the boom is out of water (FIG. 5), which increases its stability, the floats moving to a working position at a distance from the barrier when the boom is afloat (FIG. 6).

Suitable means (not shown) will be used to limit the angular deflection of the floats 7*a* and 8*a*.

Irrespective of the selected embodiment, the arms 9 and 10 (FIG. 1) or the assemblies of the floats with the connecting arms 7*a* and 8*a* (FIGS. 5 and 6) may be secured to the stiffening elements 4 amd 5 either in a permanent or a detachable manner.

To facilitate the displacement of the boom on the shore, it will be possible to equip at least some of the buoyant units with bearing elements provided with rollers (rollers 21, FIG. 1, 21*a*, FIGS. 5 and 6), skids, or wheels, these elements being either directly placed under the floats, or secured to horizontal members 23 and 23*a* at the bottom of the stiffeners.

What is claimed is:

1. A floating boom comprising a flexible structure making up a barrier equipped with transverse stiffeners having floats secured thereto for supporting said flexible structure in a substantially vertical position in water, each stiffener with said floats secured thereto making up a part of a buoyant unit, with successive buoyant units being interconnected by an assembly of articulated linking rods extending longitudinally along the upper part of the boom for supporting said flexible structure making up the barrier, and said linking rods being interconnected by slidable coupling means.

2. A floating boom comprising a flexible structure making up a barrier equipped with transverse stiffeners having floats secured thereto for supporting said flexible structure in a substantially vertical position in water, each stiffener with said float secured thereto making up a part of a buoyant unit, and each transverse stiffener comprising at its upper part a sleeve having two articulated linking rods inserted therein connecting each stiffener to adjacent stiffeners to make up a succession of buoyant units, with at least one of said rods being slidable in the sleeve, and said linking rods extending longitudinally along the upper part of the boom for supporting said flexible structure making up the barrier.

3. A floating boom as in claim 2, wherein at least one of said two rods is articulated in the vicinity of said sleeve.

4. A floating boom comprising a flexible structure making up a barrier equipped with transverse stiffeners having floats secured thereto for supporting said flexible structure in a substantially vertical position in water, each stiffener with said floats secured thereto making up a part of a buoyant unit, with successive buoyant units being interconnected by an assembly of articulated linking rods extending longitudinally along the upper part of the boom for supporting said flexible structure making up the barrier, said flexible structure comprising a flexible traction resistant armouring secured to said articulated linking rods, and each of said stiffeners being made up of two elements, one on each side of said armouring with said armouring pressed therebetween.

5. A floating boom as in claim 4, wherein said armouring comprises vertically and horizontally extending high tensile strength flexible strips, and said vertically extending strips being folded around said longitudinally extending articulated linking rods at the upper part of the armouring.

6. A floating boom comprising a flexible structure making up a barrier equipped with transverse stiffeners each having two floats, one on each side thereof and secured thereto by means of two arms, each one corresponding to a float and fixed to the upper part of the stiffeners, with each of said arms forming with the respective float a profiled singe-piece assembly having a cross-section progressively decreasing from the outer end of the float to the point at which it is fixed to said stiffener, each float being hingedly connected to said stiffener and associated with means for limiting the spacing of said arms from the stiffeners when placed in operation, and each stiffener with said floats secured making up a part of a buoyant unit, with successive buoyant units being interconnected by an assembly of articulated linking rods extending longitudinally along the upper part of the boom for supporting said flexible structure making up the barrier.

7. A floating boom comprising a flexible structure making up a barrier equipped with transverse stiffeners each having two floats, one on each side thereof and secured thereto by means of two arms, each one corresponding to a float and fixed to the upper part of the stiffeners, with each of said arms forming with the respective float a profiled single-piece assembly having a cross-section progressively decreasing from the outer end of the float to the point at which it is fixed to said stiffener, with the single-piece assembly being detachable, and each stiffener with said floats secured thereto making up a part of a buoyant unit, with successive buoyant units being interconnected by an assembly of articulated linking rods extending longitudinally along the upper part of the boom for supporting said flexible structure making up the barrier.

8. A floating boom as in claim 1, 2, 3, 4, 5, 6 or 7 wherein at least some of said buoyant units comprise, at their lower part, bearing elements provided with displacement means to facilitate displacement of the boom on shore, and wherein said displacement means is rollers, skids or wheels.

9. A floating boom as in claim 5, wherein said high tensile strength flexible strips are made of a core of plastic material reinforced with filaments, and wherein said filaments are one of metal wires, glass fibers, carbon fibers, or fibers of plastic materials.

* * * * *